US006513901B1

(12) United States Patent
Walker

(10) Patent No.: US 6,513,901 B1
(45) Date of Patent: Feb. 4, 2003

(54) METHOD AND APPARATUS FOR DETERMINING DROP VOLUME FROM A DROP EJECTION DEVICE

(75) Inventor: Ray Allen Walker, Eugene, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/968,345

(22) Filed: Sep. 28, 2001

(51) Int. Cl.[7] ..... B41J 29/393
(52) U.S. Cl. ..... 347/19; 73/1.05
(58) Field of Search ..... 347/12, 19, 40, 347/81; 73/1.03, 1.05, 1.74; 436/46

(56) References Cited

U.S. PATENT DOCUMENTS 4,067,019 A * 1/1978 Fleischer et al. ..... 347/81
4,323,905 A * 4/1982 Reitberger et al. ..... 347/19
4,551,731 A * 11/1985 Lewis et al. ..... 347/78
5,434,430 A * 7/1995 Stewart ..... 347/19
5,473,351 A * 12/1995 Helterline et al. ..... 347/19
5,539,434 A * 7/1996 Fuse ..... 347/19
5,640,183 A * 6/1997 Hackleman ..... 347/40
5,975,677 A * 11/1999 Marler et al. ..... 347/40
6,039,430 A 3/2000 Helterline et al. ..... 347/19
6,062,668 A * 5/2000 Cruz-Uribe ..... 347/19
6,065,824 A 5/2000 Bullock et al. ..... 347/19
6,086,190 A 7/2000 Schantz et al. ..... 347/81
6,315,383 B1 * 11/2001 Sarmast et al. ..... 347/19

* cited by examiner

*Primary Examiner*—Judy Nguyen
*Assistant Examiner*—Blaise Mouttet
(74) *Attorney, Agent, or Firm*—Kevin B. Sullivan

(57) ABSTRACT

A device for determining drop volume for a drop ejection device is disclosed. The drop ejection device has a drop ejector and a reference drop ejector that exhibits less drop volume variation than the drop ejector. The drop ejection device includes a sensor responsive to impinging drops for producing a signal proportional to drop volume. The sensor is responsive to drops from the drop ejector to produce an electrical signal. The sensor is responsive to drops from the reference drop ejector to produce a reference electrical signal. Also included is a processing device responsive to the electrical signal and reference electrical signal for determining drop volume of the drop ejector relative to drop volume of the reference drop ejector.

20 Claims, 7 Drawing Sheets

METHOD AND APPARATUS FOR DETERMINING DROP VOLUME FROM A DROP EJECTION DEVICE

BACKGROUND OF THE INVENTION

The present invention relates to drop ejection devices such as ink jet printing devices and the like. More particularly, this invention relates to a method and apparatus for detecting volume variation between individual drop ejection devices.

Drop ejection devices are used to eject a wide range of fluids for a variety of different applications. For printing applications, drop ejection devices are used to eject a marking fluid such as ink onto a print media. Drop ejection devices are used in other applications as well, such as to eject modeling fluid in the case of three-dimensional modeling and to eject various medications in the case of medical delivery devices such as inhalers.

One such drop ejection device is a resistive heating device that is used to rapidly heat an aqueous fluid. The drop ejection device is activated by passing an electric current through the resistive heating device such as a resistor. In response to the electric current, the resistive heating device produces heat, that in turn, heats the aqueous fluid in a vaporization chamber adjacent the resistive heating device. Once the fluid reaches vaporization, a rapidly expanding vapor front forces fluid within the vaporization chamber through an adjacent orifice or nozzle. The vaporization chamber is replenished with fluid and the drop ejection device is ready to eject a second drop upon activation of the resistive heating device. Frequently, a plurality of drop ejection devices are formed with each drop ejection device capable of being activated individually.

U.S. Pat. No. 6,086,190, assigned to the assignee of the present invention, discloses a drop detecting technique for identifying defective drop ejection devices of a plurality of drop ejection devices. Drop ejection devices have various failure mechanisms. Permanent failures of individual nozzles can result from a defect in the heating element that prevents vaporization and drop ejection. Other permanent failures result from deposits forming within the vaporization chamber and on the heating element preventing proper transfer of heat from the heating element to the ejection fluid. Failures that are not permanent, such as the accumulation of dried ink on the nozzles require cleaning of the nozzles before ink can be ejected again. By determining nozzle failures, the printing system can take appropriate action to remedy the situation. In the case where one or more nozzle requires cleaning, this nozzle cleaning routine can be performed by the printing system to remedy this failure mode. In the case where a permanent failure has occurred in one or more individual drop ejection devices, the printing system can compensate for the individual nozzle that has failed.

The drop detection device disclosed in U.S. Pat. No. 6,086,190 includes a sensing element. The sensing element has an electric potential applied between the sensing element and the printhead. As drops are ejected from the printhead, charge is accumulated on the sensing element. Each drop of ink ejected from the printhead causes a spike or pulse of electric charge as these drops strike the sensing element. A sense amplifier produces an output signal in response to the electrical voltage imparted onto the sensing element by the ink drops.

There is an ever present need to accurately determine volumes of drops ejected from drop ejection devices. Accurate determination of drop volume is important for determining a volume of fluid ejected so that a volume of fluid remaining can accurately be determined. In addition, accurate determination of drop volume allows the drop ejection system to compensate for changes in drop volume over time. These drop volume determining devices should have low manufacturing costs so as to not add significantly to the cost of the drop ejection system. Finally, these drop volume determining devices should be capable of being relatively easily manufactured in a high volume manufacturing environment.

SUMMARY OF THE INVENTION

A device for determining drop volume for a drop ejection device is disclosed. The drop ejection device has a drop ejector and a reference drop ejector that exhibits less drop volume variation than the drop ejector. The drop ejection device includes a sensor responsive to impinging drops for producing a signal proportional to drop volume. The sensor is responsive to drops from the drop ejector to produce an electrical signal. The sensor is responsive to drops from the reference drop ejector to produce a reference electrical signal. Also included is a processing device responsive to the electrical signal and reference electrical signal for determining drop volume of the drop ejector relative to drop volume of the reference drop ejector.

DETAILED DESCRIPTION

Figure 1:
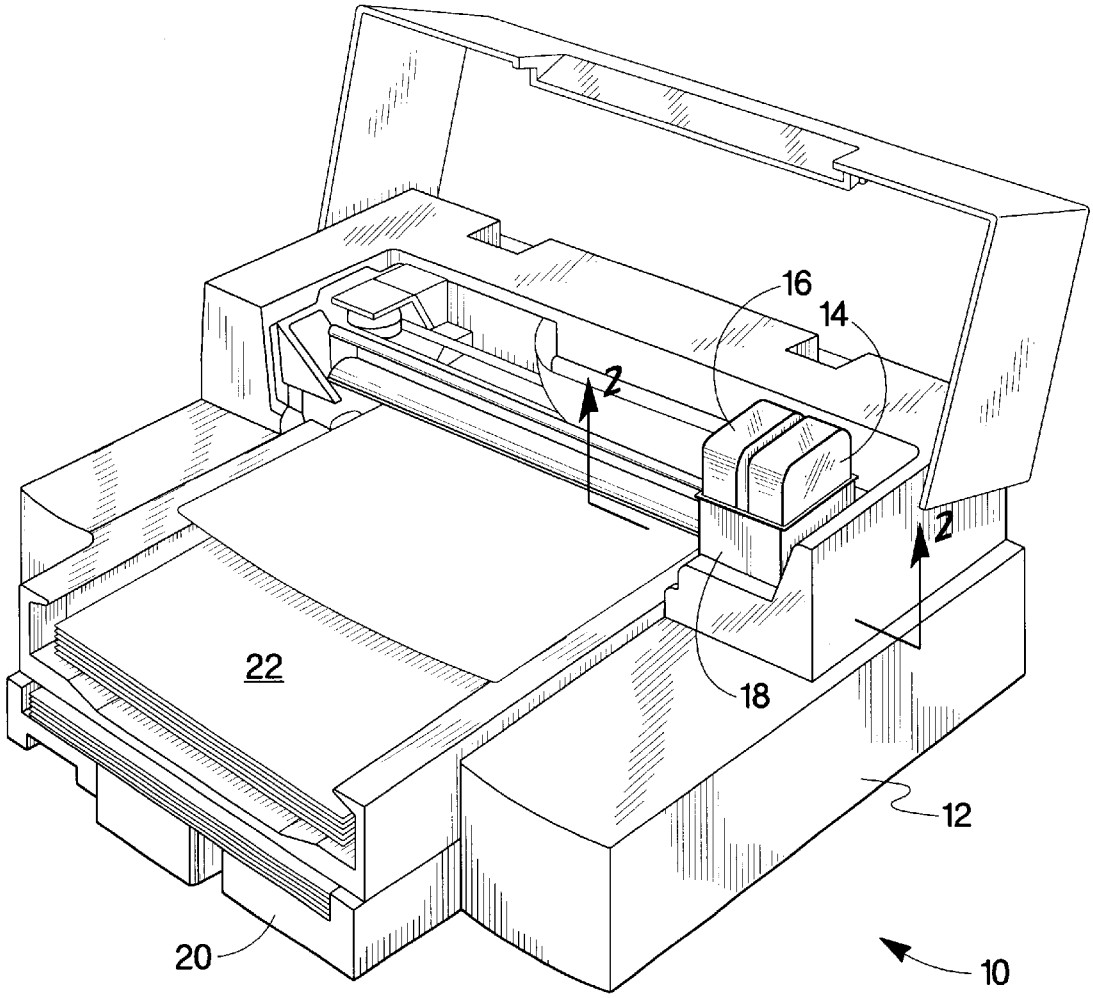
FIG. 1 is an exemplary embodiment of an ink jet printing system that includes a drop ejection device and a device for determining drop volume for the drop ejection device.

FIG. 1 is perspective view of one exemplary embodiment of a drop ejection device that makes use of the technique of the present invention for determining drop volume. This exemplary embodiment is of an ink jet printing system 10 that is shown with its cover open. The ink jet printing system 10 includes a printer portion 12 having at least one print cartridge, 14 and 16, installed in a scanning carriage 18. The printing portion 12 includes a media tray 20 for receiving media 22. As print media 22 is stepped through a print zone, the scanning carriage 18 moves the print cartridges 14 and 16 across the print media. The printer portion 12 selectively activates drop ejection devices within a printhead portion (not shown) associated with each of the print cartridges 14 and 16, to deposit ink on media thereby accomplishing printing.

In the preferred embodiment, the ink jet printhead includes a plurality of drop ejectors for depositing ink on media. Each of the plurality of drop ejectors exhibits a drop volume variation over time. A reference drop ejector is provided on the ink jet printhead that exhibits less drop volume variation over time than the plurality of drop ejectors. The printing system 10 includes a sensor (not shown) for sensing relative drop volume between each of the plurality of drop ejectors and the reference drop ejector. Drop volume for each of the plurality of drop ejectors is then determined relative to the reference drop ejection device.

The determination of drop volume of the drop ejectors relative to the reference drop ejector allows drop volume variation over time to be accurately determined. The ability to accurately determine changes in drop volume over time allows the printing system 10 to properly compensate for this drop volume variation. By accounting for drop volume variation over time, the printing system 10 can more accurately determine ink usage by tracking the number of drops ejected. This ink usage information is important for accurately determining amounts of remaining ink. It is important to accurately project remaining ink in order to ensure a printing system 10 does not run out of ink before replacement consumables can be acquired.

Drop volume variation over time can result in degradation in print quality of the output image. For example, drop volume variation over time can result in changes in hue resulting from drop volume variation associated with one color being greater than drop volume variation associated with one or more other colors. This hue shifting can be compensated for by accurately determining drop volume variation and compensating for this drop volume variation. This technique for determining drop volume will be discussed in more detail with respect to FIGS. 2–7.

Figure 2:
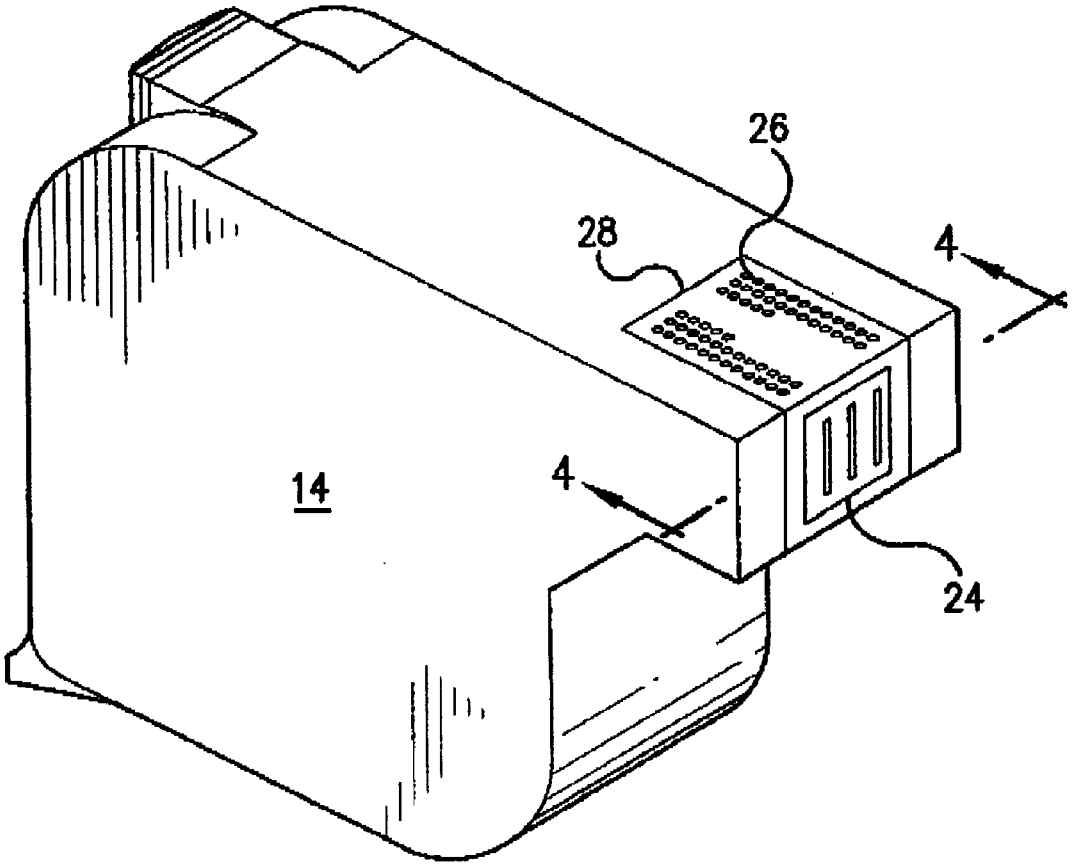
FIG. 2 is an exemplary embodiment of an ink jet print cartridge that includes a drop ejection device having a drop ejector and a reference drop ejector.

FIG. 2 is a bottom perspective view of one exemplary embodiment of the print cartridge 14 shown in FIG. 1. In the exemplary embodiment, the cartridge 14 is a three-color cartridge containing cyan, magenta, and yellow inks. In this exemplary embodiment, a separate print cartridge 16 is provided for black ink. The present invention will herein be described with respect to this exemplary embodiment by way of example only. There are numerous other configurations in which the method and apparatus of the present invention is also suitable. The technique of the present invention for determining drop volume from a drop ejection device is applicable to a wide variety of drop ejection devices as will be discussed herein. Therefore, the technique of the present invention is applicable equally to different arrangements of ink colors in the printing system as well as drop ejection systems for other applications such as medical, drug delivery, and three-dimensional modeling just to name two.

The ink cartridge 14, shown in FIG. 2, includes a printhead portion 24 that is responsive to activation signals from the printing system 12, for selectively depositing ink on media 22. In the exemplary embodiment, the printhead 24 is defined on a substrate such as silicon. The print cartridge 14 includes a plurality of electrical contacts 26 that are disposed and arranged on the print cartridge 14 so that when properly inserted into the scanning carriage, electrical contact is established between the corresponding electrical contacts (not shown) associated with the printer portion 12. Each of the electrical contacts 26 is electrically connected to the printhead 24 by each of a plurality of electrical conductors (not shown). In this manner, activation signals from the printer portion 12 are provided to the ink jet printhead 24.

In the exemplary embodiment, electrical contacts 26 are defined in a flexible circuit 28. The flexible circuit 28 includes an insulating material such as polyamide and a conducted material such as copper. Conductors are defined within the flexible circuit to electrically connect the electrical contacts 26 to electrical contacts defined on the printhead 24. The printhead 24 is mounted and electrically connected to the flexible circuit 28 using a suitable technique such as tape automated bonding (TAB).

Figure 3:
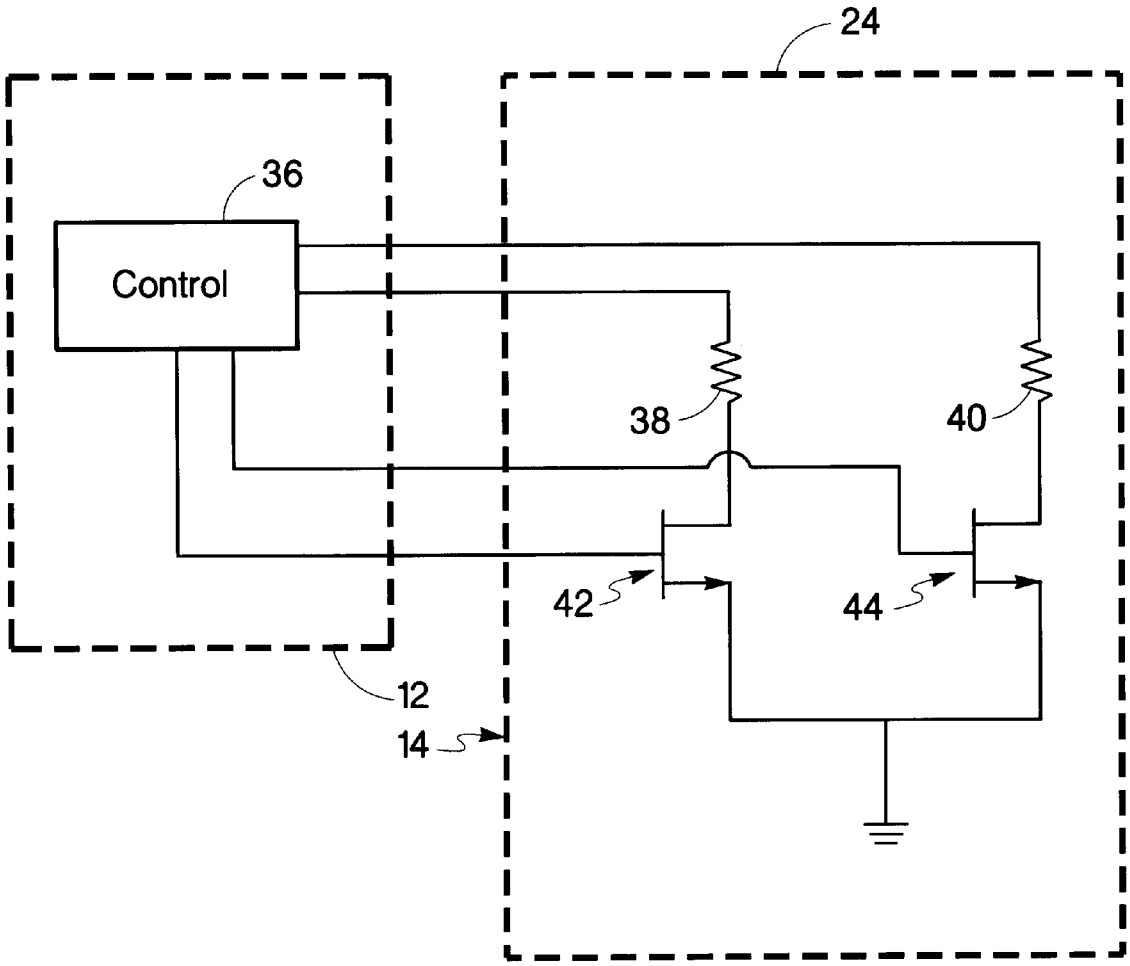
FIG. 3 is a schematic representation of an exemplary drop ejection device having a drop ejector and a reference drop ejector.

FIG. 3 is a simplified electrical block diagram of the printer portion 12 and one of the print cartridges 14. The printer portion 12 includes a print control device 36 for providing activation signals to the print cartridge 14.

The print cartridge 14 includes a pair of drop ejectors 38, 40 represented by heating devices or resistors and a pair of switching devices 42 and 44 that when activated, conduct current through the corresponding drop ejectors 38 and 40, respectively. Drop ejectors 38 and 40 are alternatively formed using other drop ejection technology as well, such as piezo technology, whereby drops are ejected by mechanical vibration.

In the case of thermal drop ejection devices, each drop ejection device includes a vaporization chamber, a resistive heating element disposed proximate the vaporization chamber, and an orifice or nozzle adjacent the vaporization chamber. The drop ejection device is activated by passing an electric current through the drop ejectors (e.g., heating elements) 38, 40, to provide sufficient heat to vaporize a portion of the fluid within the vaporization chamber. As a vapor front expands, fluid within the vaporization chamber is forced from the corresponding orifice or nozzle. In this manner, small droplets of fluid can be selectively ejected.

In the exemplary embodiment shown in FIG. 3, the printhead 24 shows two drop ejectors 38 and 40 that can be activated individually by the control device 36. The printhead 24 in general has a large number of drop ejectors 38 and 40 to increase the overall speed of the printing system. In the exemplary embodiment, the switching devices 42 and 44 are shown as a field effect transistor (FET). The switching devices can alternatively be a wide variety of switching devices capable of selectively activating the drop ejectors or resistors 38 and 40.

The drop ejectors 38 and 40, exhibit a drop volume variation based on use or activation of the drop ejectors, 38 and 40. Therefore, the more the drop ejectors, 38 and 40 are used, the greater the drop volume will vary from the initial drop volume. It is this drop volume variation over time that the technique disclosed herein is used to measure.

Several mechanisms that produce drop volume variation over time or use of the drop ejectors 38, 40 include the alteration of a surface of the heating elements that changes heat transfer characteristics of the heating elements. This surface change resulting from heating cycles, referred to as cogation, tends to alter drop volume over time for the drop ejectors 38, 40. Another mechanism that tends to produce drop volume variation over time is wear and tear on the heating elements resulting from cavitation adjacent the heating elements. Yet another mechanism tending to produce drop volume variation over time is changes in surface conditions with use of an orifice of nozzle from which ink is ejected. These changes tend to change wetting characteristics of the nozzle that tend to alter drop volume over time.

Figure 4:
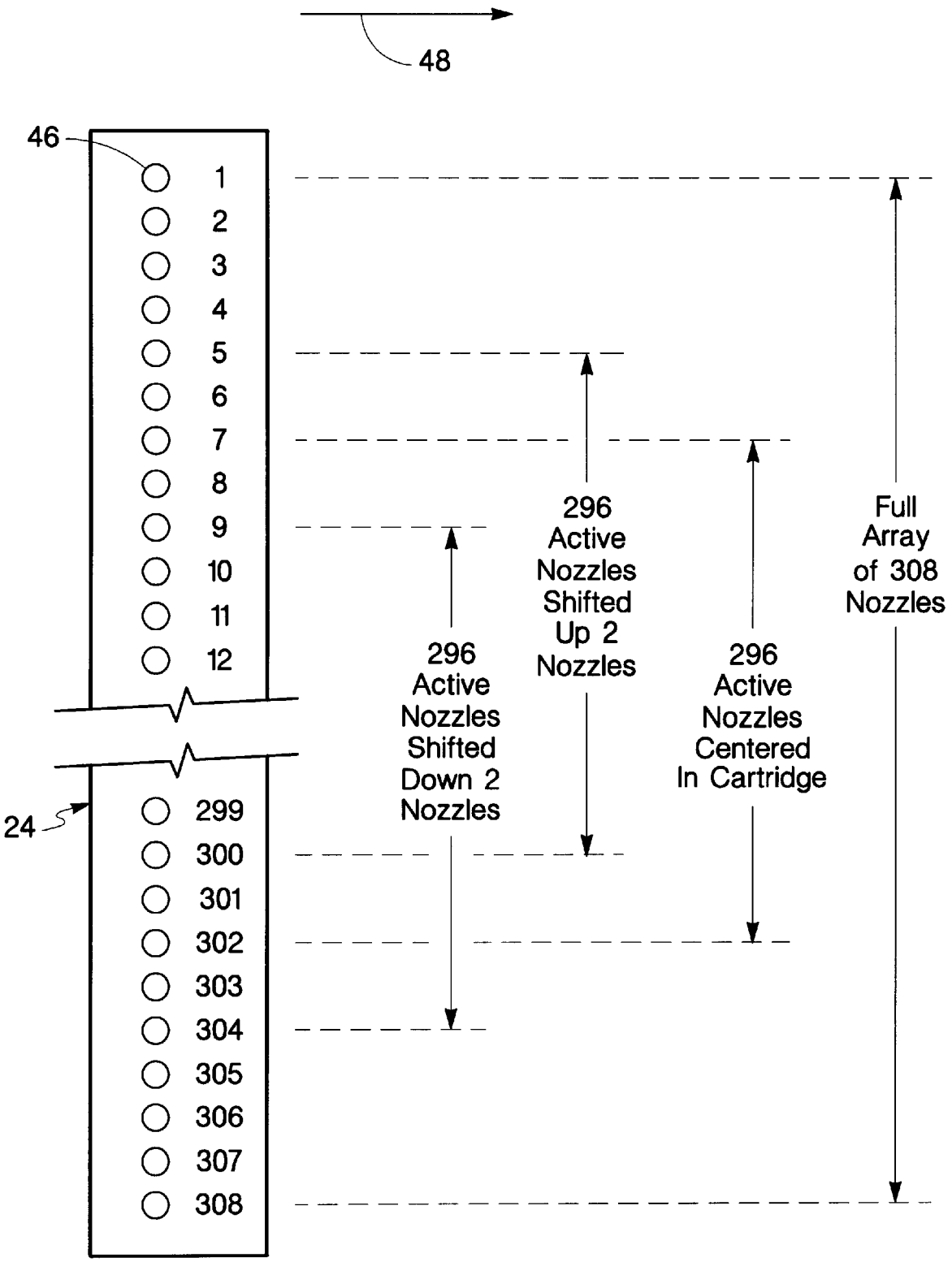
FIG. 4 depicts a simplified representation of the drop ejection device of FIG. 2.

FIG. 4 is a simplified representation of an arrangement of nozzles or orifices 46 disposed on the printhead 24 shown in FIG. 2. In this simplified representation, 308 nozzles 46 are shown in FIG. 4 numbered 1 through 308. Each nozzle 46 has an individual drop ejector 38, 40 associated therewith such as shown in FIG. 3. More specifically, each nozzle 46 of the plurality of nozzles has a heating resistor associated therewith for ejecting ink from the orifice 46. Therefore, the number of resistors will be equal to the number of nozzles 46 shown in FIG. 4.

In the exemplary embodiment, the scan axis is represented by axis 48. The nozzles 46 are arranged generally in a linear fashion orthogonal to the scan axis 48. As the print cartridge 14 is moved along the scan axis 48, a print swath is printed on the print media 22 as shown in FIG. 1.

In this exemplary embodiment, the print cartridge 14 must be properly aligned with print cartridge 16 so that the print swaths associated with each print cartridge 14 and 16 properly overlap. In order to accomplish alignment, a greater number of nozzles 46 or drop ejectors 33, 40 are provided than are actually being used during printing. This alignment technique allows for the nozzles 46 that will be used to be selected after the cartridges 14 and 16 are installed into the printing system 10. The group or array of active nozzles 46 is then selected by the printing system 10 such that proper alignment is achieved.

An exemplary embodiment of this alignment process will now be discussed with respect to FIG. 4. The active print swath in this example is made up of an array of 296 nozzles represented by nozzles or drop generators 7 through 302. These nozzles are centered on the printhead. Each nozzle 46 on the printhead 24 has a nozzle pitch associated with it, which is the nozzle spacing or distance between centers of the nozzles 46 measured in a direction orthogonal to the scan axis 48.

For the case where the cartridge is misaligned such that the print swath is misaligned by a distance of two nozzle pitches, the nozzles selected can be nozzles 5 though 300 to shift the print swath upward or vertically two nozzle pitches to achieve alignment. Alternatively, if the active print swath is offset in the opposite direction by two nozzle pitches, then the nozzles 46 or drop ejectors that are selected are numbers 9 through 304 to shift the print swath vertically downward a distance of two nozzle pitches to properly achieve alignment between print swaths associated with print cartridges 14 and 16. In this manner, by providing a greater number of nozzles 46 or drop ejectors and selecting only a subset of these nozzles 46 or drop ejectors in various alignment functions can be performed by the printing system to ensure high quality printed images.

The nozzle arrangement in FIG. 4 is intended only to be an illustrative example whereby printhead 24 contains a set of drop ejectors or nozzles 46 and during operation of the printhead 24, only a subset of the drop ejectors or nozzles 46 are used during the printing process. Unused drop ejectors or nozzles 46 may be used in cleaning routines and various alignment routines used by the printing system 10 and are not actively used to print images during normal printing. As discussed previously, drop ejectors or nozzles 46 experience drop volume variation over use. The drop ejectors that are used during normal printing operation will experience significantly more activation cycles or operation time and the drop ejectors or nozzles 46 that are not selected to be used during normal printing operations. Therefore, the drop volume variation will be greater-for these drop ejectors or nozzles 46 that are used during normal printing than the drop ejectors or nozzles 46 that are not selected for use during normal printing.

The technique as described herein makes use of drop ejectors or nozzles 46 that are not used during normal printing, which will herein be referred to reference drop ejectors, or nozzles 46. Measuring drop weight or drop volume of drop ejectors or nozzles 46 that are used during the active printing operation relative to the drop weight or drop volume of reference drop ejectors or nozzles 46 that are not used during normal printing operation allows a more accurate determination of the drop weight or drop volume of the drop ejectors or nozzles 46 that are used during normal operation. An exemplary technique for determining drop weight or drop volume for the drop ejectors or nozzles 46 will now be discussed with respect to FIGS. 5, 6, and 7.

Figure 5:
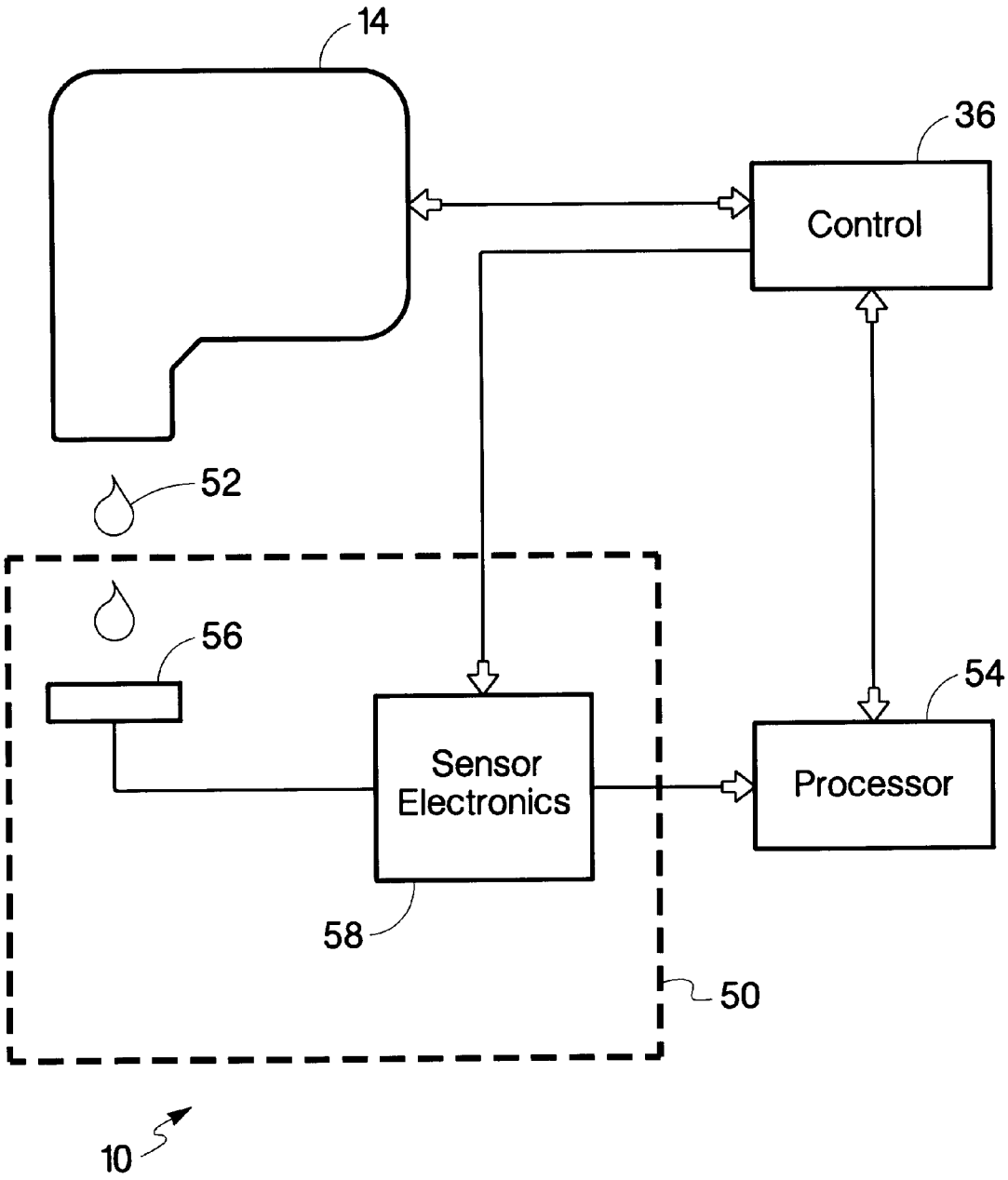
FIG. 5 is a block diagram of the exemplary printing system shown in FIG. 1 that includes the drop ejection device and the device for determining drop volume for the drop ejection device.

FIG. 5 is a block diagram for one exemplary embodiment of the printing system which includes a drop ejection device or print cartridge 14, sensor 50 that is responsive to impinging drops 52 ejected from the drop ejectors and providing a signal proportional to drop volume to a processor 54 that is responsive to signals from the sensor 50 for providing drop volume for the drop ejector relative to the reference drop ejector. By determining drop weight or drop volume of the active drop ejectors relative to reference drop ejector or ejectors that are not used as much as the active drop ejectors, the change in drop volume over time for the drop ejectors can be determined.

Once accurate drop volumes or drop weights are determined for the active drop ejectors, this information is provided to the printer controller 36 for compensating for these changes in drop volume over time to provide higher quality output images. In addition, the controller 36 with this more accurate determination of drop volume or drop weight can more accurately track ink usage to provide a more accurate estimation remaining ink. More accurate ink remaining information provides a better predictor for when replacement ink supplies will be needed.

In the exemplary embodiment, the sensor 50 includes a sensing element 56 and sensor electronics 58. The sensing element 56, in one exemplary embodiment, is an electrostatic drop detection (EDD) sensor. In this preferred embodiment, the sensor 50 senses induced charge developed on a drop as the drop impinges an electric field to produce an electrical signal. The electrical signal is processed by the sensor electronics 58 to produce an electrical signal proportional to drop volume. While an EDD sensor is used in this exemplary embodiment, other types of drop weight sensors are also suitable. The sensor 50 of the exemplary embodiment will now be discussed in more detail with respect to FIG. 6.

Figure 6:
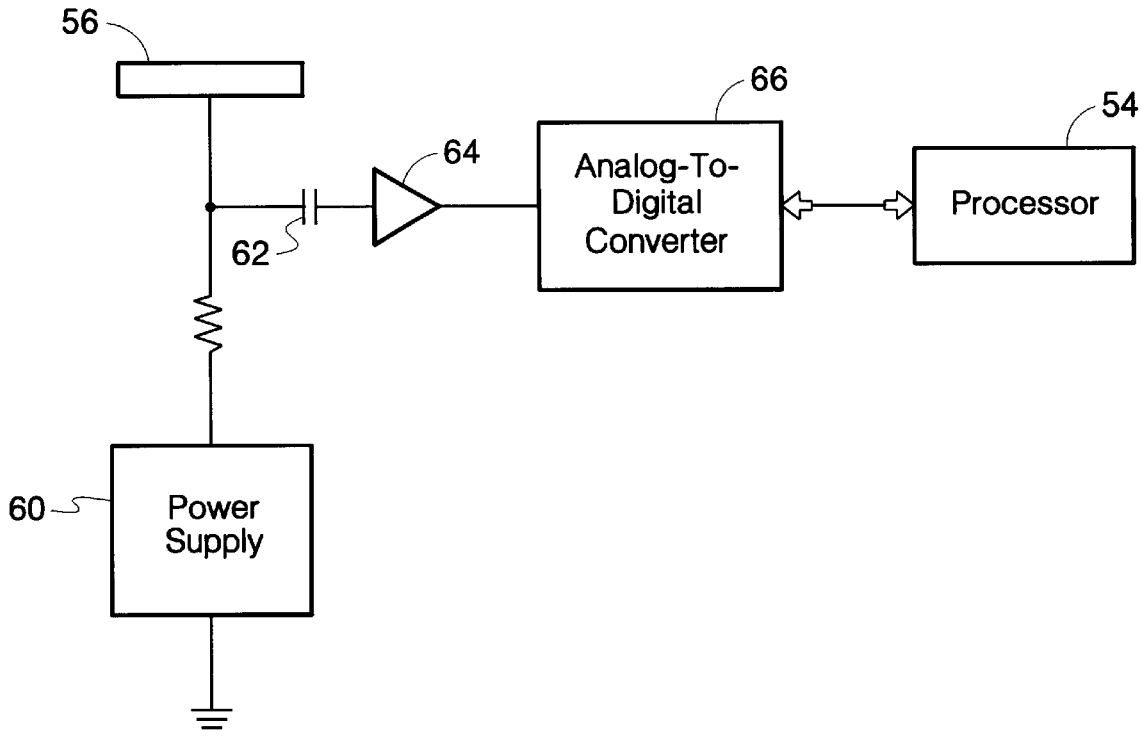
FIG. 6 is a block diagram for one exemplary embodiment of the sensor shown in FIG. 5.

FIG. 6 is a block diagram of an exemplary embodiment of the EDD sensor shown in FIG. 5. The sensor 50 includes the sensing element 56. As the print cartridge 14 under the control of a printer controller 36 ejects a series of ink drops 52 during an ink drop test cycle. A relatively high electric field is established between the printhead on the print cartridge 14 and the sensing element 56 by a power supply 60. The relatively high electric field between the printhead on the printhead cartridge 14 and the sensing element 56 causes a accumulation of electric charge in the portions of the ink drops 52 closest to the sensing element 56 as they shear away from the nozzle of the printhead. As each of the ink drops separate from the printhead, it retains its accumulated electric charge. Each of the ink drops 52 thus transports its induced charge to the sensing element 56.

As a consequence, each of the ink drops 52 imparts a spike or pulse of electric charge onto the sensing element 56 as it makes contact. The spikes or pulses on the sensing element 56 are AC coupled through an input capacitor 62 to an input of a sense amplifier 64. The sense amplifier 64 generates an output signal in response to voltage imparted onto the sensing element 56 by bursts of ink drops 52. The sense amplifier 64 amplifies the pulses and provides some filtering. The sense amplifier 64 provides a signal that is proportional to drop volume, which is provided to an analog to digital converter 66. The analog to digital converter converts the analog signal to a digital signal, which is then provided to the processor 54. Processor 54 provides digital signal processing functions on the digitized version of the output signal from the sense amplifier 64. The digital signal processing function is performed by the processor 54 to determine a magnitude of the output signal at the predetermined frequency or pattern of frequencies in which ink drops are ejected from the printhead 24 on the print cartridge 14. This magnitude provides a drop detection value that is then used to characterize ink drops ejected from the printhead 24 during an ink drop test cycle. The processor 54 characterizes drops ejected based on ink volume of each drop. The technique for determining relative drop volume between the drop ejection device and the reference drop ejection device will now be discussed with respect to FIG. 7.

Figure 7:
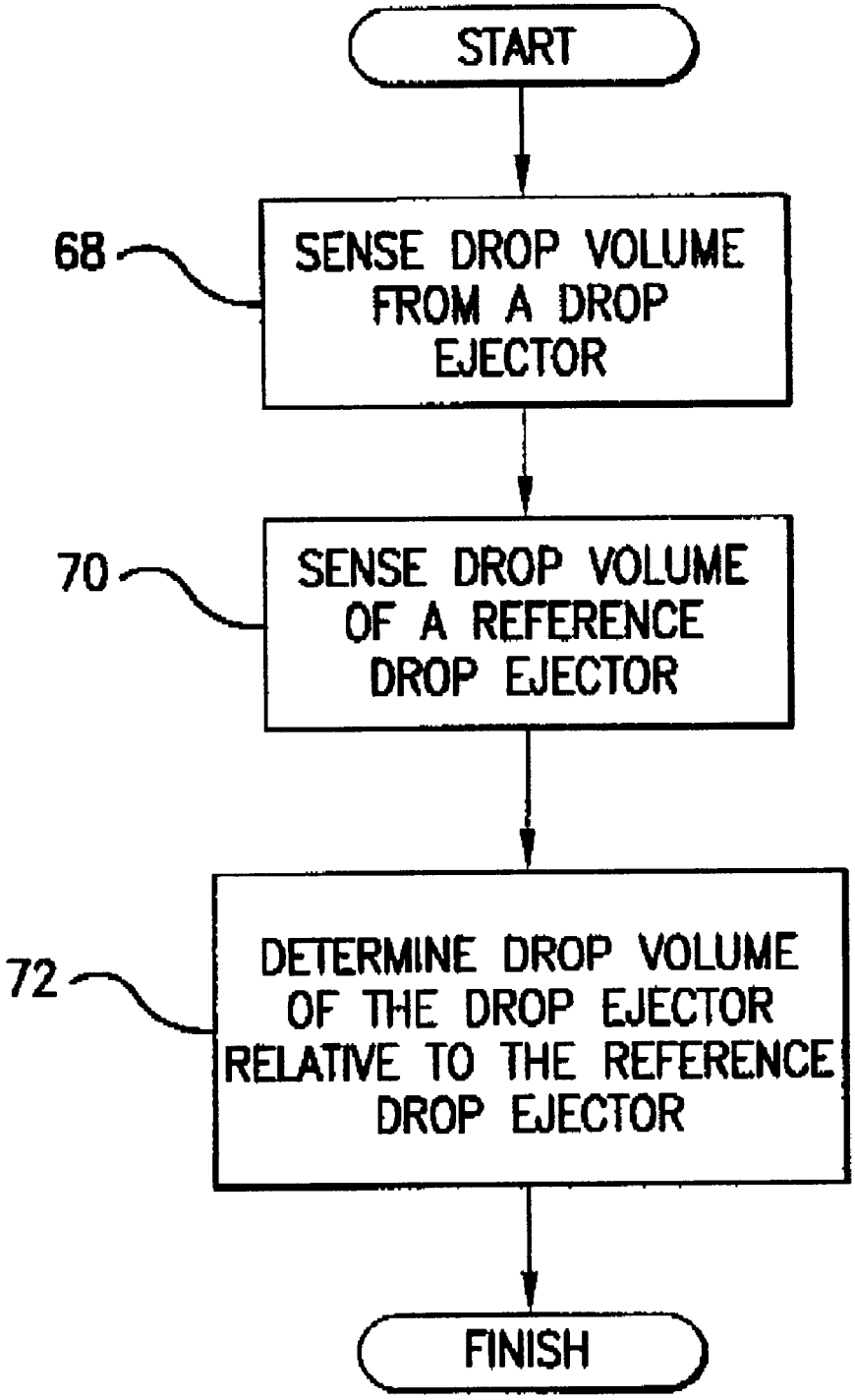
FIG. 7 is a flow diagram illustrating an exemplary method for determining drop volume using the exemplary device shown in FIG. 5.

FIG. 7 is a flow diagram illustrating the technique for accurately determining drop volume or drop weight for a drop ejection device. A drop volume for a drop ejector is sensed as represented by step 68. A drop volume of a reference drop ejector is sensed as represented by step 70. Using each of the sensed drop volume for the drop ejector and the reference drop ejector, the drop volume of the drop ejector relative to the reference drop ejector is determined as represented by step 72.

The technique described herein provides a more accurate determination of drop volume because the drop volume of the reference drop ejector is known. The reference drop ejector has a drop volume that is substantially constant. Therefore, the changes in drop volume of the drop ejector can be accurately determined because these changes are relative to a known or constant drop volume that is associated with the reference drop ejector. By accurately determining drop volume changes over time, the printing system 10 can compensate for these changes to ensure high print quality. Furthermore, by accurately determining changes in drop volume over time, ink usage can more accurately be determined thereby providing a more accurate gas gauge of ink remaining in the print cartridges for ink containers within the printing system 10.

What is claimed is:

1. A device for determining drop volume for a drop ejection device having a drop ejector and a reference drop ejector that exhibits less drop volume variation than the drop ejector comprising:

a sensor responsive to impinging drops for providing a signal proportional to drop volume, the sensor responsive to drops from the drop ejector to produce an electrical signal and the sensor responsive to drops from the reference drop ejector to produce a reference electrical signal; and a processing device responsive to the electrical signal and reference electrical signal for determining drop volume of the drop ejector relative to drop volume of the reference drop ejector.

2. The device for determining drop volume of claim 1 wherein the sensor senses induced charge developed on a drop as the drop impinges an electric field to produce an electrical signal proportional to drop volume.

3. The device for determining drop volume of claim 1 wherein the drop ejector has a higher use rate than the reference drop ejector.

4. The device for determining drop volume of claim 1 wherein the drop ejector has a drop volume associated therewith than varies with use.

5. The device for determining drop volume of claim 1 wherein the drop ejection device is an inkjet printhead.

6. The device for determining drop volume of claim 1 wherein a drop volume for the reference drop ejector is predetermined and the drop volume for the drop ejector is determined relative to the reference drop ejector.

7. A method for determining drop volume for a drop ejection device having a drop generator and a reference drop generator, the reference drop generator exhibits less drop volume variation that the drop generator, the method comprising:

generating an electrical signal in response to activation of the drop generator, the electrical signal proportional to drop volume for the drop generator;

generating a reference electrical signal in response to activation of the reference drop generator, the electrical signal proportional to drop volume for the reference drop generator; and determining a relative drop volume for the drop generator based on each of the electrical signal and the reference electrical signal.

8. The method of claim 7 wherein prior to generating an electrical signal in response to activation of the drop generator the method includes determining drop volume for the reference drop generator.

9. The method of claim 7 wherein the drop ejection device is an inkjet printhead.

10. The method of claim 7 wherein generating each of the electrical signal and the reference electrical signal is accomplished by a sensor that senses induced charge developed on a drop as the drop impinges an electric field to produce an electrical signal proportional to drop volume.

11. A printing device comprising:

a plurality of drop ejectors for depositing ink on media and a reference drop ejector that exhibits less drop volume variation than the plurality of drop ejectors;

a sensing device responsive to impinging drops from the printing device for providing a signal proportional to drop volume; and a processing device responsive to sensing device signals corresponding to a drop ejector of the plurality of drop generators and sensing device signals corresponding to the reference drop ejector for providing drop volume for the drop ejector relative to the reference drop ejector.

12. The printing device of claim 11 wherein the plurality of drop ejectors have a higher use rate than the reference drop ejector.

13. The printing device of claim 11 wherein drop volume variation over time for each of the plurality of drop ejectors is greater than drop volume variation over time for the reference drop ejector.

14. The printing device of claim 11 wherein the reference drop generator is not used to form images on media.

15. The printing device of claim 11 wherein the sensing device senses induced charge developed on a drop as the drop impinges an electric field to produce an electrical signal proportional to drop volume.

16. The printing device of claim 11 wherein the plurality of drop ejectors have a drop volume associated therewith that varies with use.

17. The printing device of claim 11 wherein the plurality of drop ejection devices and the reference drop ejector are disposed on an inkjet printhead.

18. The printing device of claim 11 wherein a drop volume for the reference drop ejector is predetermined and the drop volume for the plurality of drop ejection devices are determined relative to the reference drop ejector.

19. The printing device of claim 11 wherein the reference drop ejector is a plurality of reference drop ejectors.

20. The printing device of claim 11 wherein the reference drop ejector is an unused drop generator that is selected in printhead alignment.

* * * * *